US005996703A

United States Patent [19]

Yamamoto et al.

[11] Patent Number: 5,996,703

[45] Date of Patent: Dec. 7, 1999

[54] DOZING APPARATUS OF A BULLDOZER

[75] Inventors: Shigeru Yamamoto; Hidekazu Nagase, both of Hirakata, Japan

[73] Assignee: Komatsu Ltd., Tokyo, Japan

[21] Appl. No.: 09/297,264

[22] PCT Filed: Oct. 29, 1997

[86] PCT No.: PCT/JP97/03958

§ 371 Date: Apr. 28, 1999

§ 102(e) Date: Apr. 28, 1999

[87] PCT Pub. No.: WO98/24986

PCT Pub. Date: Jun. 11, 1998

[30] Foreign Application Priority Data

Feb. 12, 1996 [JP] Japan ..... 8-321885

[51] Int. Cl.[6] ..... E02F 3/85

[52] U.S. Cl. ..... 172/4.5; 172/7; 701/50

[58] Field of Search ..... 172/2, 3, 4, 4.5, 172/7, 12; 701/50

[56] References Cited

U.S. PATENT DOCUMENTS

| | | | |
|---|---|---|---|
| 4,630,685 | 12/1986 | Huck, Jr. et al. | 172/2 |
| 5,487,428 | 1/1996 | Yamamoto et al. | 172/4.5 |
| 5,564,507 | 10/1996 | Matsushita et al. | 172/3 |
| 5,621,643 | 4/1997 | Nakagami et al. | 172/3 X |
| 5,924,493 | 7/1999 | Hartman et al. | 172/4.5 |

FOREIGN PATENT DOCUMENTS

| | | |
|---|---|---|
| 1-163324 | 6/1989 | Japan . |
| 3-43523 | 2/1991 | Japan . |
| 4-285214 | 10/1992 | Japan . |
| 5-106239 | 4/1993 | Japan . |
| 7-11665 | 1/1995 | Japan . |
| 7-26586 | 1/1995 | Japan . |
| 7-54374 | 2/1995 | Japan . |
| 9-209394 | 8/1997 | Japan . |

*Primary Examiner*—Christopher J. Novosad
*Attorney, Agent, or Firm*—Armstrong, Westerman, Hattori, McLeland & Naughton

[57] ABSTRACT

Smooth, effective dumping is achieved by automating. A switching point, at which a carrying mode is switched to a dumping mode during automatic driving in a dozing operation, is set beforehand. A dumping attitude of the blade is also preset for a desired traveling distance of the bulldozer from the switching point to a dumping point. The actual traveling distance of the bulldozer from the switching point is detected, based on which the blade is controlled so as to take the preset attitude.

8 Claims, 11 Drawing Sheets

FLOW CHART OF A PROCESS FOR AUTOMATIC DUMPING CONTROL

FLOW CHART OF A PROCESS FOR AUTOMATIC DUMPING CONTROL

DOZING APPARATUS OF A BULLDOZER

TECHNICAL FIELD

The invention relates to a dozing system well suited for use in a bulldozer and more particularly to a technique for automating a load dumping process in dozing operation by use of a bulldozer.

BACKGROUND ART

Generally, dozing operation with a bulldozer is carried out under manual control by the operator. A typical manual operation by the operator involves, blade raising, blade lowering, tilting and pitching. In such operation, the operator controls the load on the blade caused by digging and carrying to be constant while avoiding a running slip (shoe slip) of the vehicle body. Load dumping is carried out such that the operator raises the blade with the captured soil therein and allows the blade to pitch so that the blade is emptied to mound the soil (mounding). In the case of dumping soil, for instance, from a cliff (dropping), the operator operates the blade so as to be pushed horizontally, with the cutting edge of the blade kept in a certain position relative to the ground.

Such manual operation not only requires operator's skill and experience but also involves frequent manipulation of the blade and other members, so that the operator gets tremendous fatigue, no matter how skillful he is. To automate dozing operation to solve this problem, several automatic blade control techniques for bulldozers have been, up to now, proposed and put to practical use.

One such automatic control technique for load dumping is proposed by the applicant of the present invention and disclosed in Japanese Patent Publication (KOKAI) Gazette No. 7-26586 (1995). The automatic dozing control system for a bulldozer disclosed in this publication comprises a laser beam receiving sensor mounted on the bulldozer and a laser beam projector located at a digging completion point (dumping point) on the ground. Upon detection of the arrival of the bulldozer at the dumping point by means of the laser beam receiving sensor and the laser beam projector, the transmission is automatically shifted from forward gear into reverse gear.

As mentioned earlier, load dumping dependent on manual operation causes tremendous fatigue to the operator and cannot provide smooth load dumping. The publication No. 7-26586 only teaches shifting of the transmission between forward gear and reverse gear upon the arrival of the bulldozer at the dumping point, but does not disclose the control of the blade to dump soil.

The present invention is directed to overcoming the above problems and the prime object of the invention is therefore to provide a dozing system for a bulldozer, which is capable of automating a dumping process to smoothly and effectively dump the contents of the blade.

DISCLOSURE OF THE INVENTION

According to one aspect of the invention, the above object can be achieved by a dozing system for a bulldozer, the system comprising:

(a) switching point setting means for setting a switching point at which a carrying mode is switched to a dumping mode in automatic driving in a dozing operation;

(b) blade dumping attitude setting means for setting a dumping attitude of a blade for a desired traveling distance of the bulldozer from the switching point set by the switching point setting means to a dumping point;

(c) actual traveling distance detecting means for detecting the actual traveling distance of the bulldozer from the switching point; and (d) blade controlling means for controlling the blade to take the attitude which has been set by the blade dumping attitude setting means, according to the actual traveling distance detected by the actual traveling distance detecting means.

In the above arrangement having the first feature of the invention, the switching point setting means sets a switching point at which a carrying mode is switched to a dumping mode and the blade dumping attitude setting means sets a dumping attitude of the blade for a desired traveling distance of the bulldozer from the set switching point to a dumping point. Accordingly, a dumping attitude of the blade in accordance with the distance from the switching point to the dumping point can be set, for instance, in the form of a data map. Based on this data map and the actual traveling distance of the bulldozer detected by the actual traveling distance detecting means, the blade is so controlled as to take the attitude set by the blade dumping attitude setting means. In this way, load dumping can be automated without entailing hard work to the operator, so that smooth and effective load dumping operation can be assured. Consequently, a sequence of automated operations composed of digging, carrying and dumping is enabled.

According to another aspect of the invention, there is provided a dozing system for a bulldozer, the system comprising:

(a) switching point setting means for setting a switching point at which a carrying mode is switched to a dumping mode in automatic driving in a dozing operation;

(b) blade dumping attitude setting means for setting a dumping attitude of a blade for a desired traveling time period taken by the bulldozer to travel from the switching point set by the switching point setting means to a dumping point;

(c) actual traveling time detecting means for detecting the actual traveling time of the bulldozer traveling from the switching point; and (d) blade controlling means for controlling the blade to take the attitude which has been set by the blade dumping attitude setting means, according to the actual traveling time detected by the actual traveling time detecting means.

While the attitude of the blade is controlled based on the actual traveling distance of the bulldozer in the first aspect of the invention, the feature of the second aspect resides in that the attitude of the blade is controlled based on the actual traveling time period of the bulldozer. By setting the dumping attitude of the blade for a travelling time period taken by the bulldozer to travel from a switching point to a dumping point, the same effects as those of the first aspect can be obtained.

In the invention, the blade dumping attitude setting means may set a dumping attitude of the blade by setting the vertical position of the blade in relation to the vehicle body, or by setting the pitch angle of the blade in relation to the vehicle body. Alternatively, it may set a dumping attitude of the blade by setting both the vertical position and pitch angle of the blade.

The switching point setting means may set a switching point through a teaching operation or by means of a dial switch.

In addition, the actual traveling distance detecting means is designed to detect the actual traveling distance of the bulldozer by integrating an actual ground speed detected by a Doppler sensor or by integrating an actual ground speed obtained from the rotational speed of crawler belt sprockets.

BEST MODE FOR CARRYING OUT THE INVENTION

Referring now to the accompanying drawings, a dozing system for a bulldozer will be described according to a preferred embodiment of the invention.

Figure 1:
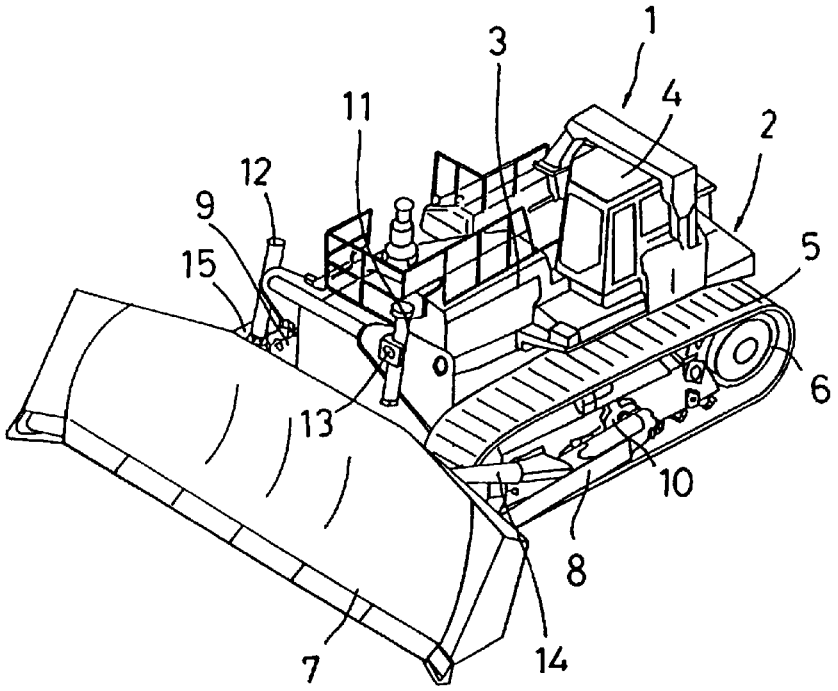
FIG. 1 is an outside view of a bulldozer according to one embodiment of the invention.
Figure 2:
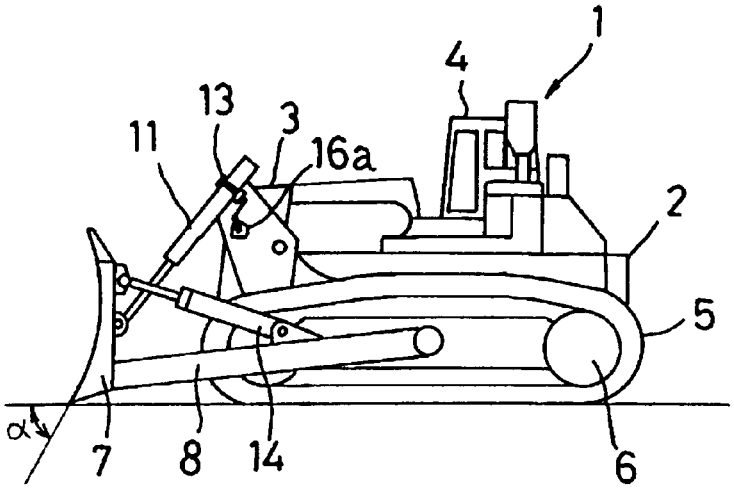
FIG. 2 is a side view of the bulldozer according to the embodiment.

FIG. 1 and FIG. 2 show an outside view and a side view, respectively, of a bulldozer according to one embodiment of the invention.

In the bulldozer 1 of the present embodiment, there are provided, on a vehicle body 2, a bonnet 3 for housing an engine 20 (to be described later) and a cab 4 for the operator who drives the bulldozer 1. Disposed on both right and left sides of the vehicle body 2 when viewed in the forward traveling direction of the vehicle body 2 are crawler belts 5 (the crawler belt on the right side is not shown in the drawing) for driving the vehicle body 2 so as to travel forwardly and reversely and turn. The crawler belts 5 are respectively independently driven by driving power transmitted from the engine 20 with the aid of their corresponding sprockets 6.

A blade 7 is provided in front of the vehicle body 2. The blade 7 is supported on the leading ends of right and left straight frames 8, 9 the base ends of which are, in turn, pivotally supported at the sides of the vehicle body 2 through trunnions 10 (the trunnion on the right side is not shown in the drawing) such that the blade 7 can be raised or lowered in relation to the vehicle body 2. A pair of side-by-side blade lift cylinders 11, 12 are arranged between the blade 7 and the vehicle body 2, for raising or lowering the blade 7. The blade cylinders 11 and 12 are supported, at their base ends, by yokes 13 rotatably attached to the vehicle body 2. The other ends of the blade lift cylinders 11 and 12 are pivotally supported on the back face of the blade 7. For controlling the blade 7 to take a digging attitude, pitch dump attitude or pitch back attitude (which attitudes are to be described later), blade pitch cylinders 14, 15 are disposed between the blade 7 and the right and left straight frames 8, 9.

The vehicle body 2 is provided with yoke angle sensors 16*a*, 16*b* for detecting the pivotal angle of each yoke 13 and therefore the pivotal angles of the blade lift cylinders 11 and 12. Note that the right yoke angle sensor is shown in only FIG. 3. The blade lift cylinders 11, 12 are provided with stroke sensors 19*a*, 19*b* (shown in only FIG. 3) respectively for detecting the strokes of these cylinders 11, 12. As shown in the hydraulic circuit diagram of FIG. 3, hydraulic pressure sensors 17H, 17B are disposed in the hydraulic pipe lines for supplying hydraulic pressure to the respective head sides and bottom sides of the blade lift cylinders 11, 12. These sensors 17H, 17B detect hydraulic pressure at the head and bottom sides of the blade lift cylinders 11, 12, respectively. The outputs of the yoke angle sensors 16*a*, 16*b*, the stroke sensors 19*a*, 19*b* and the hydraulic pressure sensors 17H, 17B are entered to a controller 18 consisting of a micro computer. In the controller 18, the information from these sensors is utilized in the arithmetic operation for obtaining the vertical reactive force (described later) of the blade 7.

Figure 4:
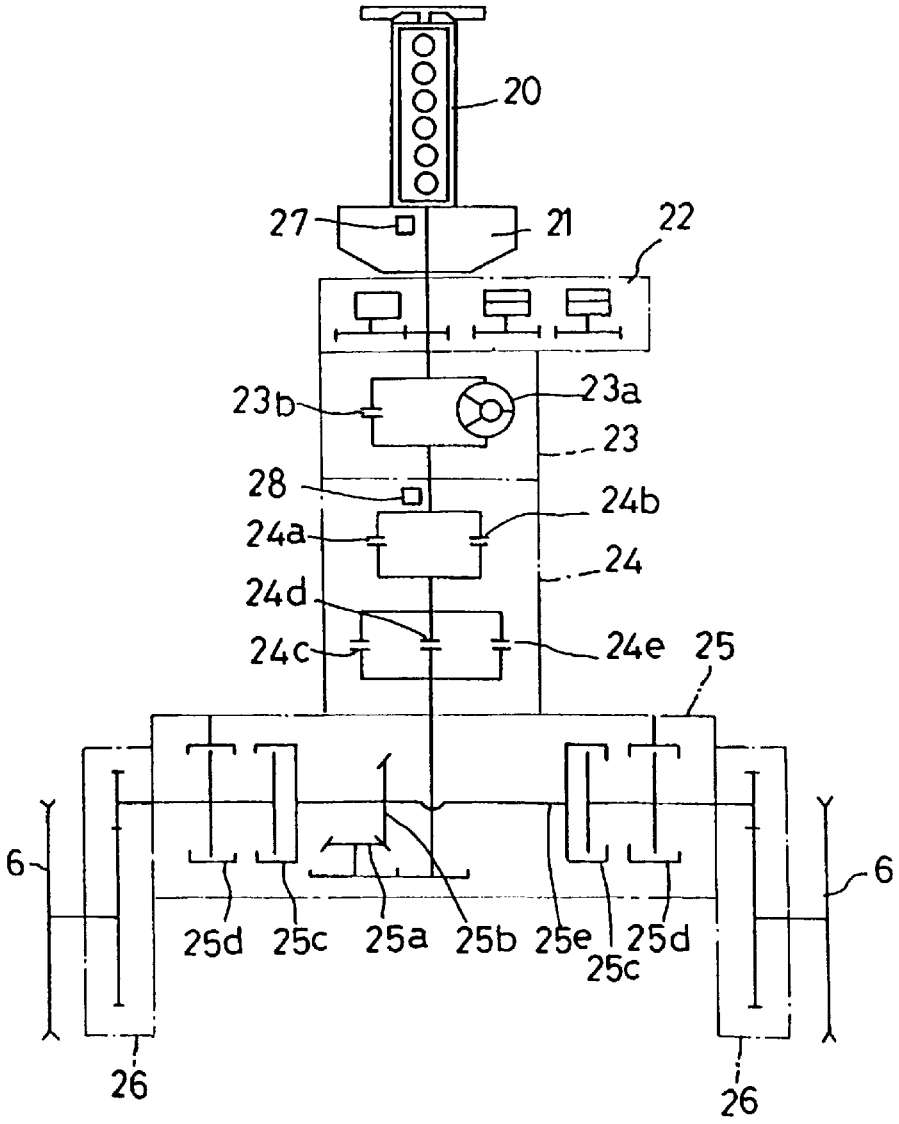
FIG. 4 is a skeleton diagram of a power transmission system.

Referring to FIG. 4 which shows a power transmission system, the rotary driving power of the engine 20 is transmitted to a damper 21 and to a PTO 22 for driving various hydraulic pumps including an implement operating hydraulic pump and then to a torque converter unit 23 having a torque converter 23*a* and a lock-up clutch 23*b*. The rotary driving power is then transmitted from the output shaft of the torque converter unit 23 to a transmission 24 (e.g., wet multiple disc clutch type planetary gear transmission) which has an input shaft connected to the output shaft of the torque converter unit 23. The transmission 24 comprises a forward drive clutch 24*a*, a reverse drive clutch 24*b* and first to third speed clutches 24*c*, 24*d*, 24*e*, so that the output shaft of the transmission 24 is rotated in three speed ranges in both forward drive and reverse drive. The rotary driving power from the output shaft of the transmission 24 is transmitted to paired right and left final reduction gear mechanisms 26 through a steering system 25 to power the respective sprockets 6 for running the crawler belts 5 (not shown in FIG. 4). The steering system 25 has a transverse shaft 25*e* having a pinion 25*a*, a bevel gear 25*b*, paired right and left steering clutches 25*c* and steering brakes 25*d*. Reference numeral 27 designates an engine speed sensor for detecting the engine speed of the engine 20 and reference numeral 28 designates a torque converter output shaft revolution sensor for detecting the revolution speed of the output shaft of the torque converter unit 23.

The following data are input to the controller 18 (see FIG. 3): (i) engine speed data which is representative of the engine speed of the engine 20 and sent from the engine speed sensor 27; (ii) revolution data which is representative of the revolution speed of the output shaft of the torque converter unit 23 and sent from the torque converter output shaft revolution sensor 28; (iii) A lock-up (L/U)/torque converting (T/C) selection instruction which is representative of whether or not the torque converter unit 23 is to be locked up and sent from the lock-up selector switch (not shown).

Figure 3:
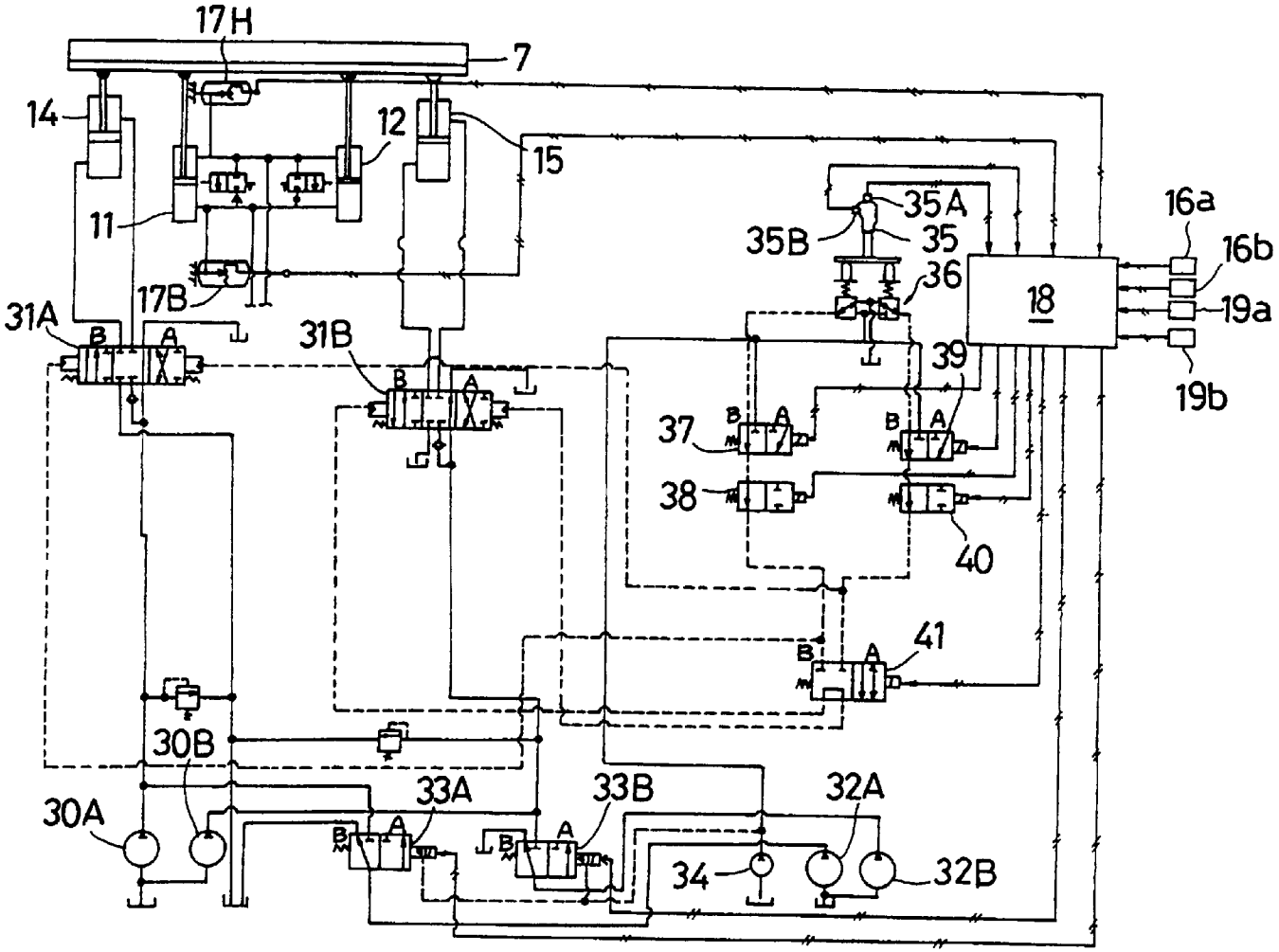
FIG. 3 is a hydraulic circuit diagram showing a pitch operation circuit for a blade.

Turning now to FIG. 3, the pitch operation circuit for pitching the blade 7 with the blade pitch cylinders 14, 15 according to the present embodiment will be explained. It should be noted that the lift operation circuit for raising the blade 7 with the blade lift cylinders 11, 12 is omitted in this hydraulic circuit.

In this hydraulic circuit, a first directional control valve 31A is connected to the discharge pipe of a fixed displacement hydraulic pump 30A for supplying hydraulic pressure to the left blade pitch cylinder 14, while a second directional control valve 31B is connected to the discharge pipe of a fixed displacement hydraulic pump 30B for supplying hydraulic pressure to the right blade pitch cylinder 15. The discharge pipe of an assist hydraulic pump 32A is connected to the discharge pipe of the hydraulic pump 30A through an assist solenoid valve 33A, while the discharge pipe of an assist hydraulic pump 32B is connected to the discharge pipe of the hydraulic pump 30B through an assist solenoid valve 33B.

The discharge pipe of a pilot pump 34 is connected to a pilot control valve 36 for an operation lever 35. The pilot control valve 36 is connected to a left tilt control valve 38 through a pitch back control valve 37 and connected to a right tilt control valve 40 through a pitch dump control valve 39. The pilot control valve 36 is also connected to the second directional control valve 31B through a pitch/tilt switching solenoid valve 41 and to the first directional control valve 31A through the pitch back control valve 37, the left tilt control valve 38, the pitch dump control valve 39 and the right tilt control valve 40.

The operation lever 35 is equipped with a pitch back selector switch 35A and a pitch dump selector switch 35B which respectively release a signal to the controller 18.

The output signal of the controller 18 is input to the assist solenoid valves 33A, 33B, the pitch back control valve 37, the pitch dump control valve 39, the left tilt control valve 38, the right tilt control valve 40 and the pitch/tilt switching solenoid valve 41 to operate these valves.

With reference to the graph (FIG. 5) showing the relationship between the actual traveling distance L of the bulldozer 1 and the pitch angle $\alpha$ (see FIG. 2) of the blade 7, there will be outlined a process for controlling the pitch angle $\alpha$ of the blade 7 in the bulldozer 1 of the above structure when the automatic driving mode is selected.

Figure 6:
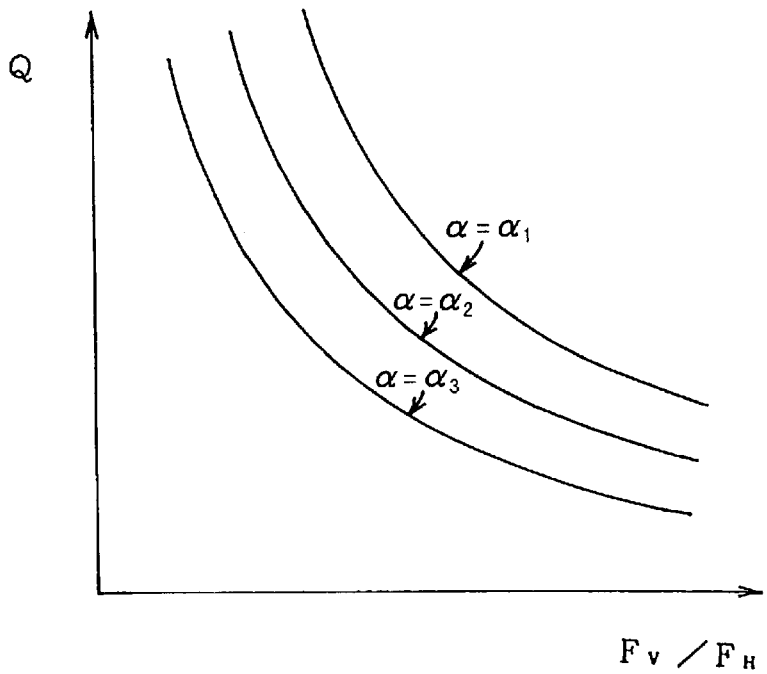
FIG. 6 is a graph showing the relationship between the ratio $F_V/F_H$ and the loading ratio Q.

A digging starting point $L_0$ and a switching point $L_c$ at which the carrying mode is switched to the dumping mode are stored in the controller 18 beforehand by means of a dial switch or through a teaching operation by the operator. In the digging mode, the pitch angle $\alpha$ of the blade 7 is controlled to be a constant value to maintain the digging attitude of the blade 7. When the digging mode is selected, the controller 18 calculates the vertical reactive force $F_V$ (i.e., the pressing force of the blade lift cylinders 11, 12) and the horizontal reactive force $F_H$ (i.e., the actual tractive force of the crawler belts 5) which forces are exerted on the blade 7, and calculates, based on these values, the ratio $F_V/F_H$ of the vertical force $F_V$ to the horizontal force $F_H$. Since the ratio $F_V/F_H$ correlates with the loading ratio Q (i.e., the ratio of the amount of excavated soil loaded on the blade to the loading capacity of the blade) with the pitch angle $\alpha$ serving as a parameter as shown in FIG. 6, the loading ratio Q is calculated from the ratio $F_V/F_H$ and the pitch angle $\alpha$. Thereafter, a target pitch angle is calculated from the loading ratio Q and the pitch angle $\alpha$, and the controller 18 outputs a pitch back command so that the attitude of the blade 7 is changed from the digging attitude to the carrying attitude.

At the time when the bulldozer 1 has reached the switching point $L_c$ after operation proceeding with the blade 7 in the carrying attitude, a target pitch angle $\alpha$ is calculated according to the preset data map (for soil mounding) in which the values of the blade pitch angle are plotted in connection with the actual traveling distance L from the switching point $L_c$. Then, a pitch dump command is output from the controller 18. Subsequently, the blade 7 is changed from the carrying attitude to the dumping attitude and the bulldozer 1 travels to the dumping point $L_d$ with the blade 7 in the dumping attitude. After dumping, the bulldozer 1 moves back a specified distance while keeping the same pitch angle as the pitch angle at the dumping point $L_d$. Thereafter, the bulldozer 1 travels back to the carrying starting point with the blade 7 kept at the pitch angle slightly larger than the pitch angle $\alpha$ of the forward travel and then travels back to the digging starting point $L_0$ with the blade 7 kept at the same pitch angle $\alpha$ as digging operation.

When the blade 7 is changed from the digging attitude to the carrying attitude, if a blade pitch back command is released from the controller 18, the pitch back control valve 37 is shifted to the position A and the pitch/tilt switching solenoid valve 41 is also shifted to the position A. At the same time, the command signal from the controller 18 is input to the assist solenoid valves 33A, 33B so that the assist solenoid valves 33A, 33B are shifted to the position A. Therefore, the fluid discharged from the assist hydraulic pumps 32A, 32B is combined with the fluid in the discharge pipe of the hydraulic pumps 30A, 30B. At that time, the pilot pressure from the pilot pump 34 is exerted on the operating part of the first directional control valve 31A through the pitch back control valve 37 and the left tilt control valve 38 and exerted on the operating part of the second directional control valve 31B through the pitch back control valve 37, the left tilt control valve 38 and the pitch/tilt switching solenoid valve 41. This allows the first directional control valve 31A and the second directional control valve 31B to be respectively shifted to the position B, and the pressure oil discharged from the hydraulic pump 30A flows into the head chamber of the blade pitch cylinder 14 through the first directional control valve 31A while the oil pressure discharged from the hydraulic pump 30B flowing into the head chamber of the blade pitch cylinder 15 through the second directional control valve 31B. As a result, the blade pitch cylinders 14, 15 are contracted simultaneously and the blade 7 rapidly pitches back (backward tipping), thereby changing from the digging attitude to the carrying attitude (i.e., pitch back attitude).

When shifting the blade 7 from the carrying attitude to the dumping attitude, if a blade pitch dump command is released from the controller 18, the pitch dump control valve 39 is shifted to the position A whereas the pitch/tilt switching solenoid valve 41 is shifted to the position A. At the same time, the command signal from the controller 18 is input to the assist solenoid valves 33A, 33B so that the assist solenoid valves 33A, 33B are shifted to the position A. Therefore, the fluid discharged from the assist hydraulic pumps 32A, 32B is combined with the fluid in the discharge pipe of the hydraulic pumps 30A, 30B. At that time, the pilot pressure from the pilot pump 34 is exerted on the operating part of the first directional control valve 31A through the pitch dump control valve 39 and the right tilt control valve 40 and exerted on the operating part of the second directional control valve 31B through the pitch back control valve 37, the left tilt control valve 38 and the pitch/tilt switching solenoid valve 41. This allows the first directional control valve 31A and the second directional control valve 31B to be shifted to the position A so that the pressure oil discharged from the hydraulic pump 30A flows into the bottom chamber of the blade pitch cylinder 14 through the first directional control valve 31A while the pressure oil discharged from the hydraulic pump 30B flows into the bottom chamber of the blade pitch cylinder 15 through the second directional control valve 31B. In this way, the blade pitch cylinders 14, 15 extend simultaneously, allowing the blade 7 to quickly pitch (forward tipping) for dumping, whereby the blade 7 is changed from the pitch back attitude to the pitch dump attitude.

Reference is now made to the graph (FIG. 7) showing the relationship between the actual traveling distance L and target tractive forces $F_0$ to roughly describe the load control of the blade 7 in the automatic driving mode.

Figure 7:
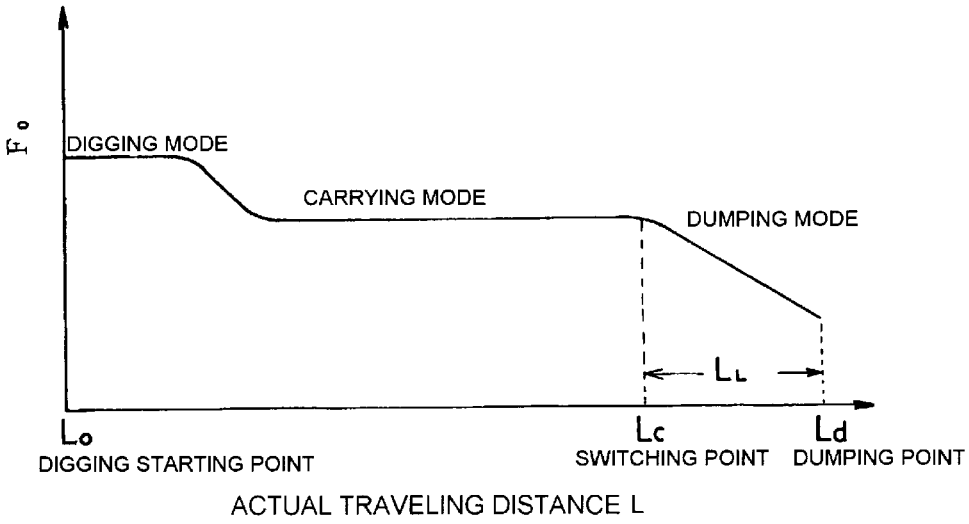
FIG. 7 is a graph showing the relationship between the actual traveling distance of the bulldozer and target tractive forces.

In the automatic driving mode, the blade 7 is controlled to make the actual tractive force exerted on the blade 7 coincident with a preset target tractive force $F_0$ (load control). Herein, the value of the target tractive force $F_0$ varies, as shown in FIG. 7, depending on which mode is selected from the automatic digging mode, automatic carrying mode and automatic dumping mode. More specifically, the target tractive force $F_0$ for the automatic digging mode and the target tractive force $F_0$ for the automatic carrying mode are set to different constant values. In the automatic dumping mode (this mode starts from the switching point $L_c$), the target tractive force $F_0$ monotonically decreases. When switching from the automatic digging mode to the automatic carrying mode, the target tractive force $F_0$ gradually changes from the value of the automatic digging mode to the value of the automatic carrying mode.

Concretely, the load control of the blade 7 is executed in the following way. First of all, (1) the difference $\Delta F$ between a target tractive force $F_0$ and an actual tractive force and (2) the difference $\Delta\psi$ between a target cutting edge position $\psi_0$ and a moving average straight frame absolute angle $\psi_2$ (i.e., the moving average of straight frame absolute angles obtained, for a given length of time, frkom a straight frame relative angle $\psi_1$ which is the average angle of the right and left straight frames 8, 9 relative to the vehicle body 2 and from the tilt angle of the vehicle body 2) are obtained. Then, either of the following processes is performed depending on whether a running slip has occurred.

1) If an occurrence of running slip is detected, a lift operation amount $Q_S$ for raising the blade 7 is obtained from a slip control characteristic map (not shown) in order to eliminate the running slip by reducing the load of excavated soil imposed on the blade 7.

2) If no running slip has been detected, lift operation amounts $Q_1$ and $Q_2$ are obtained in the following way.

Figure 8:
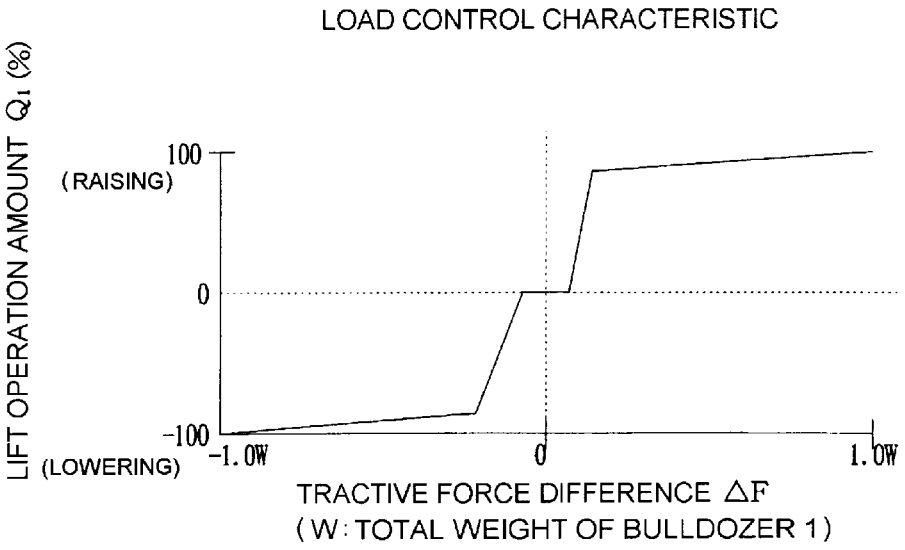
FIG. 8 is a graph of a load control characteristic map.

① The lift operation amount $Q_1$ for raising or lowering the blade 7 such that the corrected tractive force F is made equal to the target tractive force $F_0$ is obtained from the load control characteristic map shown in FIG. 8, based on the difference $\Delta F$ between the target tractive force $F_0$ and the corrected tractive force F.

Figure 9:
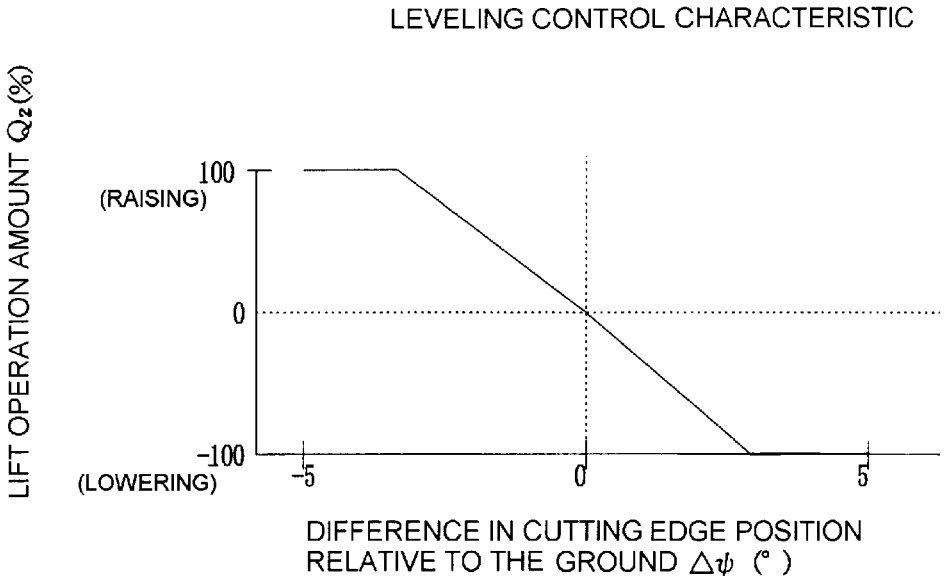
FIG. 9 is a graph of a leveling control characteristic map.

② The lift operation amount $Q_2$ for raising or lowering the blade 7 such that the moving average straight frame absolute angle $\psi_2$ is made equal to the target cutting edge position $\psi_0$ is obtained from the leveling control characteristic map shown in FIG. 9, based on the difference $\Delta\psi$ between the target cutting edge position $\psi_0$ and the moving average straight frame absolute angle $\psi_2$.

Figure 10:
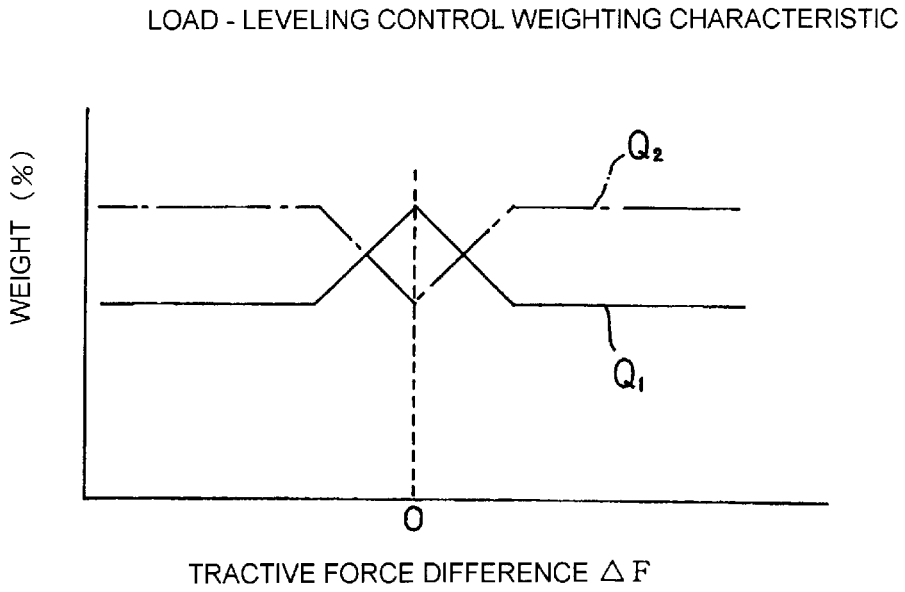
FIG. 10 is a graph of a load-leveling control weighting characteristic map.

③ A lift operation amount $Q_T$ is obtained by obtaining the sum of the lift operation amounts $Q_1$ and $Q_2$ which are weighted based on the tractive force difference $\Delta F$ according to the load-leveling control weighting characteristic map shown in FIG. 10.

The lift operation amounts $Q_S$, $Q_T$ thus obtained are fed to a blade lift cylinder controller for controlling the blade lift cylinders 11, 12 so that the blade lift cylinders 11, 12 are controlled to be driven by a lift valve actuator and a lift cylinder operation valve according to the lift operation amounts $Q_S$, $Q_T$. Accordingly, the desired control for raising or lowering the blade 7 is performed.

Figure 11:
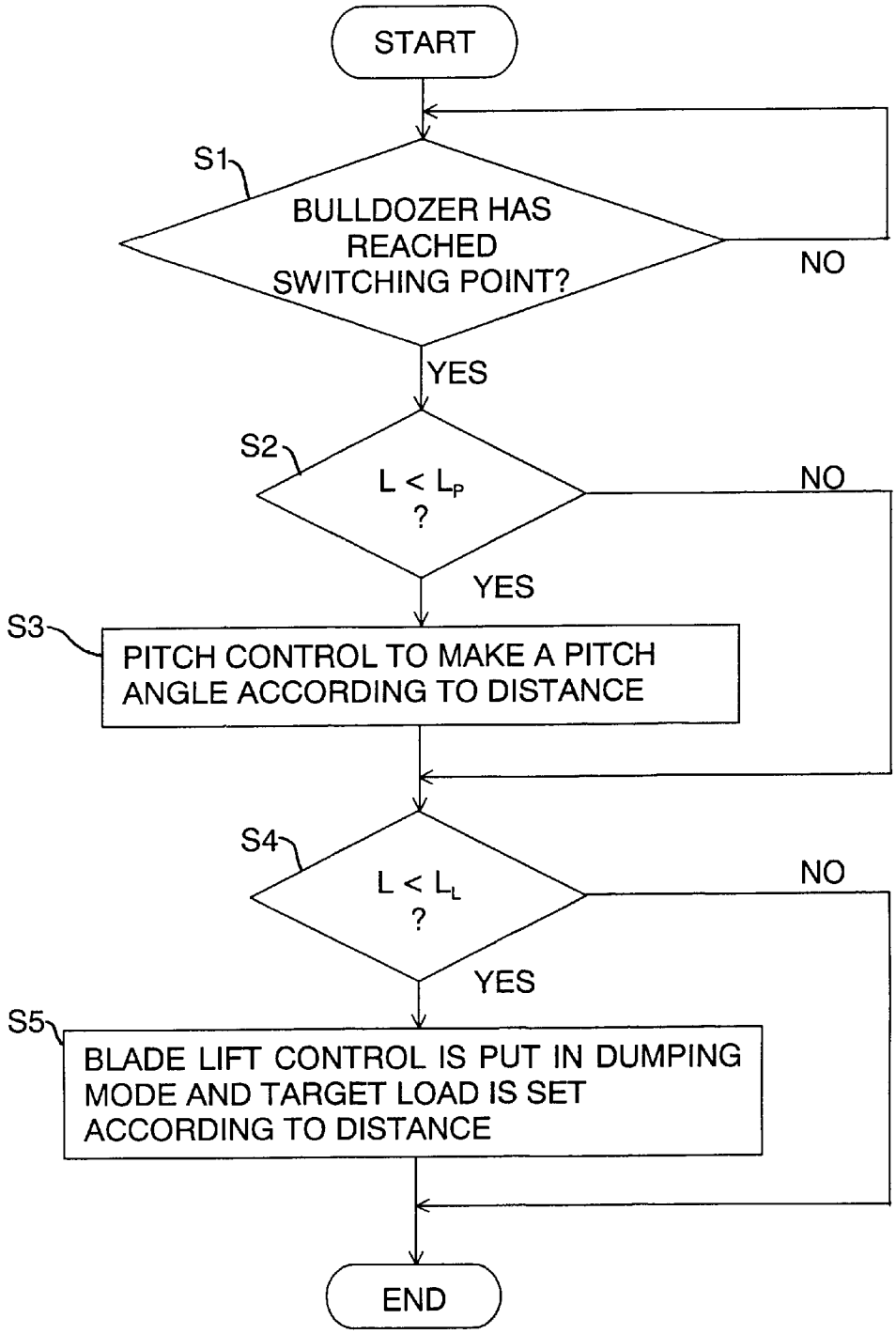
FIG. 11 is a flow chart of a process of automatic dumping control.

In the dozing system of this embodiment, dumping in the automatic driving mode for heaping up soil (mounding) is performed in accordance with the flow chart of FIG. 11.

Figure 5:
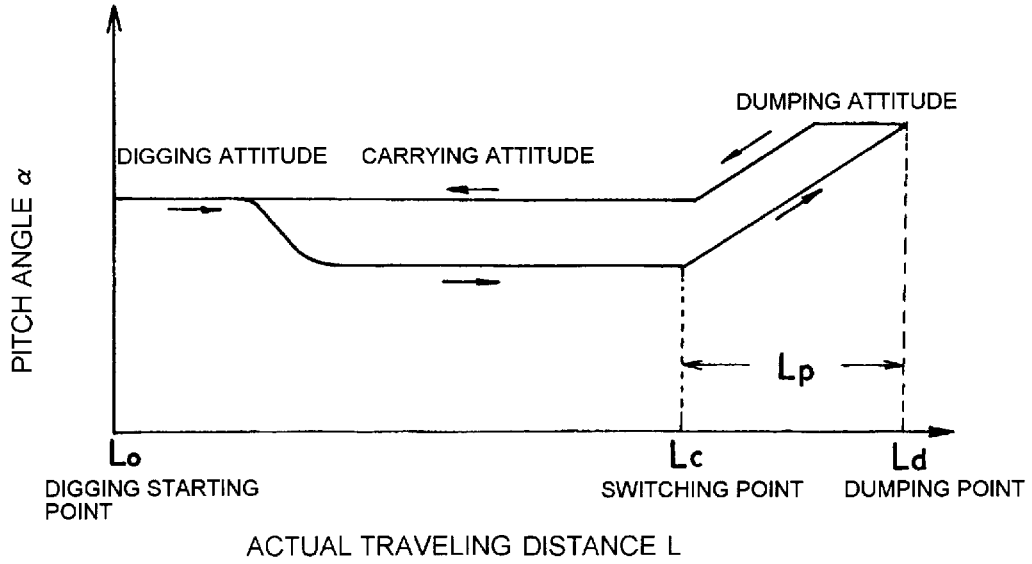
FIG. 5 is a graph showing the relationship between the actual traveling distance of the bulldozer and pitch angles.

STEPS S1 to S3: A check is made to determine whether or not the bulldozer 1 has reached the switching point $L_c$ where the preset automatic carrying mode is switched to the automatic dumping mode. If it is determined that the bulldozer 1 has reached the switching point $L_c$ and if the actual traveling distance L of the bulldozer 1 from the switching point $L_c$ is shorter than the distance $L_P$ between the switching point $L_c$ and the dumping point $L_d$ ($L<L_P$), the pitch control of the blade 7 is executed according to the data map as shown in FIG. 5 associated with the relationship between the actual traveling distance L and the pitch angle. If the actual traveling distance L reaches the distance $L_P$ between the switching point $L_c$ and the dumping point $L_d$ ($L=L_P$), the above-noted pitch control is terminated and the program proceeds to the next step.

STEPS S4 to S5: If the actual traveling distance L of the bulldozer 1 starting from the switching point $L_c$ is shorter than the distance $L_L$ between the switching point $L_c$ and the dumping point $L_d$ ($L<L_L$), the load control is executed for making the actual tractive force exerted on the blade 7 equal to the target tractive force $F_0$, according to the data map of FIG. 7 associated with the relationship between the actual traveling distance L and the target tractive force $F_0$. On the other hand, if the actual traveling distance L has reached the distance $L_L$ between the switching point $L_c$ and the dumping point $L_d$ ($L=L_L$), the above-noted load control is terminated to let the program proceed to the next step.

The detection of the actual traveling distance of the bulldozer 1 from the switching point $L_c$ may be carried out by integrating the actual ground speed detected by a Doppler sensor mounted on the vehicle body or by integrating the actual ground speed detected from the rotational speed of the crawler belt sprockets 6. These methods may be used in combination. Specifically, a check is made to determine whether the actual tractive force exerted on the blade exceeds a specified shoe slip limit, and if the actual tractive force exceeds the shoe slip limit, a vehicle detecting means having a Doppler sensor is used. If the actual tractive force is equal to or less than the shoe slip limit, a vehicle detecting means for detecting a ground speed from the rotational speed of the crawler belt sprockets is used.

In the automatic dumping control according to the present embodiment, since the level and pitch angle of the blade 7 are controlled so as to become equal to their respective set values which have been set according to the actual traveling distance of the bulldozer from a switching point, dumping operation can be automated without entailing operator's hard work and, in consequence, smooth and effective dumping operation can be ensured. This enables a sequence of automated operations which constitute a work cycle from digging to dumping.

The present embodiment has been described with the case of dumping operation by mounding soil. In the case of dumping operation by dropping soil from a high level, the load-leveling control characteristic weighting map shown in FIG. 10, which is associated with the above-described load control of the blade 7, may be arranged such that the position of the cutting edge of the blade 7 with respect to the ground may be controlled to be constant, by setting the weight for the load control to 0% and the weight for the leveling control to 100%. This makes it possible to drop soil by horizontally pushing the blade, irrespective of changes in the load exerted on the blade 7, that is, changes in the amount of soil loaded on the front face of the blade 7.

The present embodiment has been described in the concept in which the attitude of the blade 7 (i.e., height and pitch angle) is controlled according to the actual traveling distance of the bulldozer 1 from the switching point $L_c$ at which operation is switched to the automatic dumping mode. It is also possible to control the attitude (height and pitch angle) of the blade 7 according to the actual traveling time taken by the bulldozer 1 to travel from the switching point $L_c$ to the dumping point, provided that the traveling speed of the bulldozer 1 is constant.

We claim:

1. A dozing system for a bulldozer, comprising:

(a) switching point setting means for setting a switching point at which a carrying mode is switched to a dumping mode in automatic driving in a dozing operation;

(b) blade dumping attitude setting means for setting a dumping attitude of a blade for a desired traveling distance of the bulldozer from the switching point set by the switching point setting means to a dumping point;

(c) actual traveling distance detecting means for detecting the actual traveling distance of the bulldozer from the switching point; and (d) blade controlling means for controlling the blade to take the attitude which has been set by the blade dumping attitude setting means, according to the actual traveling distance detected by the actual traveling distance detecting means.

2. A dozing system for a bulldozer, according to claim 1, wherein the actual traveling distance detecting means detects the actual traveling distance of the bulldozer by integrating an actual ground speed detected by a Doppler sensor.

3. A dozing system for a bulldozer, according to claim 1, wherein the actual traveling distance detecting means detects the actual traveling distance of the bulldozer by integrating an actual ground speed obtained from the rotational speed of sprockets for crawler belts.

4. A dozing system for a bulldozer, comprising:

(a) switching point setting means for setting a switching point at which a carrying mode is switched to a dumping mode in automatic driving in a dozing operation;

(b) blade dumping attitude setting means for setting a dumping attitude of a blade for a desired traveling time period taken by the bulldozer to travel from the switching point set by the switching point setting means to a dumping point;

(c) actual traveling time detecting means for detecting the actual traveling time of the bulldozer traveling from the switching point; and (d) blade controlling means for controlling the blade to take the attitude which has been set by the blade dumping attitude setting means, according to the actual traveling time detected by the actual traveling time detecting means.

5. A dozing system for a bulldozer according to any one of claims 1 to 4, wherein the blade dumping attitude setting means sets a dumping attitude of the blade by setting the vertical position of the blade in relation to a vehicle body.

6. A dozing system for a bulldozer according to any one of claims 1 to 4, wherein the blade dumping attitude setting means sets a dumping attitude of the blade by setting the pitch angle of the blade in relation to a vehicle body.

7. A dozing system for a bulldozer according to any one of claims 1 to 4, wherein the switching point setting means sets a switching point through a teaching operation.

8. A dozing system for a bulldozer according to any one of claims 1 to 4, wherein the switching point setting means sets a switching point by a dial switch.

* * * * *

UNITED STATES PATENT AND TRADEMARK OFFICE

CERTIFICATE OF CORRECTION

PATENT NO.: 5,996,703
DATED : December 7, 1999
INVENTOR(S): Shigeru YAMAMOTO et al.

It is certified that error appears in the above-identified patent and that said Letters Patent is hereby corrected as shown below:

Item [54] The Title of the Invention, should be corrected as follows:

--DOZING SYSTEM FOR A BULLDOZER--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*